US010531725B2

(12) United States Patent
Birkert et al.

(10) Patent No.: US 10,531,725 B2
(45) Date of Patent: Jan. 14, 2020

(54) BOTTLE BRUSH

(71) Applicant: MUNCHKIN, INC., Van Nuys, CA (US)

(72) Inventors: Thomas E. Birkert, West Hills, CA (US); Sung Yun Chan, Pasadena, CA (US); Mark Gerard Tebbe, Ventura, CA (US); Steven Bryan Dunn, Beverly Hills, CA (US); Mark A. Hatherill, Beverly Hills, CA (US); Yong Sun Simon Kang, Pasadena, CA (US)

(73) Assignee: Munchkin, Inc., Van Nuys, CA (US)

( * ) Notice: Subject to any disclaimer, the term of this patent is extended or adjusted under 35 U.S.C. 154(b) by 248 days.

(21) Appl. No.: 15/415,767

(22) Filed: Jan. 25, 2017

(65) Prior Publication Data

US 2017/0208928 A1 Jul. 27, 2017

Related U.S. Application Data

(60) Provisional application No. 62/287,381, filed on Jan. 26, 2016.

(51) Int. Cl.
*A46B 5/00* (2006.01)
*A46B 5/02* (2006.01)

(52) U.S. Cl.
CPC ..... *A46B 5/0016* (2013.01); *A46B 5/0037* (2013.01); *A46B 2200/3013* (2013.01)

(58) Field of Classification Search
CPC ..... A46B 5/0016; A46B 5/0037; A46B 2200/3006
See application file for complete search history.

(56) References Cited

U.S. PATENT DOCUMENTS 5,339,480 A * 8/1994 Murg ..... A46B 3/18 15/106
5,491,863 A * 2/1996 Dunn ..... A46B 3/18 15/106

(Continued)

FOREIGN PATENT DOCUMENTS

CN 204698081 U 10/2015
DE 202004002249 U1 6/2005

(Continued)

OTHER PUBLICATIONS

International Written Opinion for PCT/US2017/015068, dated Aug. 9, 2018. (pp.-9).

(Continued)

*Primary Examiner* — Michael D Jennings
(74) *Attorney, Agent, or Firm* — Robert Z. Evora, Esq.; Fariborz Moazzam, Esq.

(57) ABSTRACT

Modular and flexible interchangeable brush system to scrub a container. The brush system includes a handle having a first core and a second core. A sleeve is provided into which the first core and the second core are disposed. A flexible stem is removably connected to the first core of the handle. The flexible stem has at least one gap into which a resilient material is disposed. The location of the gap is at a bend location along a longitudinal axis of the handle. A first brush is operatively connected to the flexible stem, and a second brush is operatively connected to, and received within, the second core of the handle.

19 Claims, 19 Drawing Sheets

(56) References Cited

U.S. PATENT DOCUMENTS

| | | | | | |
|---|---|---|---|---|---|
| 5,673,452 | A * | 10/1997 | Chang | A46B 5/0062 | 15/143.1 |
| 5,709,003 | A * | 1/1998 | Batch | A46B 13/001 | 15/106 |
| 5,735,012 | A * | 4/1998 | Heinzelman | A46B 5/002 | 15/143.1 |
| 5,903,949 | A * | 5/1999 | Halm | A46B 5/0062 | 15/143.1 |
| 6,202,247 | B1 | 3/2001 | Lorenz, Jr. | | |
| 8,336,156 | B1 * | 12/2012 | Shimazu | A47L 19/00 | 15/164 |
| D683,544 | S * | 6/2013 | Duwa | D4/121 | |
| 2007/0119011 | A1 * | 5/2007 | Ho | A46B 5/0062 | 15/172 |
| 2007/0274762 | A1 * | 11/2007 | Edwards | A46B 5/0016 | 401/39 |
| 2014/0013529 | A1 * | 1/2014 | Kilgore | A46B 9/005 | 15/106 |
| 2016/0249733 | A1 | 9/2016 | Tebbe et al. | | |

FOREIGN PATENT DOCUMENTS

| | | | |
|---|---|---|---|
| DE | 202004002249 | U1 | 7/2005 |
| EP | 2965677 | A1 | 1/2016 |

OTHER PUBLICATIONS

International Search Report and Written Opinion for PCT/US17/15068. dated Apr. 21, 2017. (pp. 22).
European Search Report and Written Opinion for 17744877.6-1113, dated Jun. 12, 2019, (pp. 7).

* cited by examiner

BOTTLE BRUSH

CROSS REFERENCE TO RELATED APPLICATIONS

This application claims priority to U.S. Provisional Patent Application Ser. No. 62/287,381, filed Jan. 26, 2016; the contents of which are hereby incorporated by reference herein in their entirety into this disclosure.

TECHNICAL FIELD

The subject disclosure relates to the field of cleaning and, in particular, to improved cleaning devices for cleaning infant nursing bottles and nipples that are hygienically flexible and versatile.

BACKGROUND

The importance of proper hygiene when handling and cleaning infant feeding tools, such as baby bottles, and nursing nipples cannot be overstated. Ideally, bottles and nipples should be thoroughly scrubbed. Proper scrubbing is especially important after a nipple or bottle has been used to dispense fatty liquids, or liquids having suspended solids therein, such as cereal. Removing food from tight corners and difficult contours in a bottle can be quite challenging. Although various solutions have been proposed, none available has effectively solved the issue of thoroughly cleaning the various contours of a container and/or other items to be cleaned.

SUMMARY OF THE SUBJECT MATTER

In one exemplary embodiment, the subject disclosure is a modular and flexible interchangeable brush system to scrub a container. The brush system includes a handle having a first core and a second core. A sleeve is provided into which the first core and the second core are disposed. A flexible stem is removably connected to the first core of the handle. The flexible stem has at least one gap into which a resilient material is disposed. The location of the gap is at a bend location along a longitudinal axis of the handle. A first brush is operatively connected to the flexible stem, and a second brush is operatively connected to, and received within, the second core of the handle.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1:
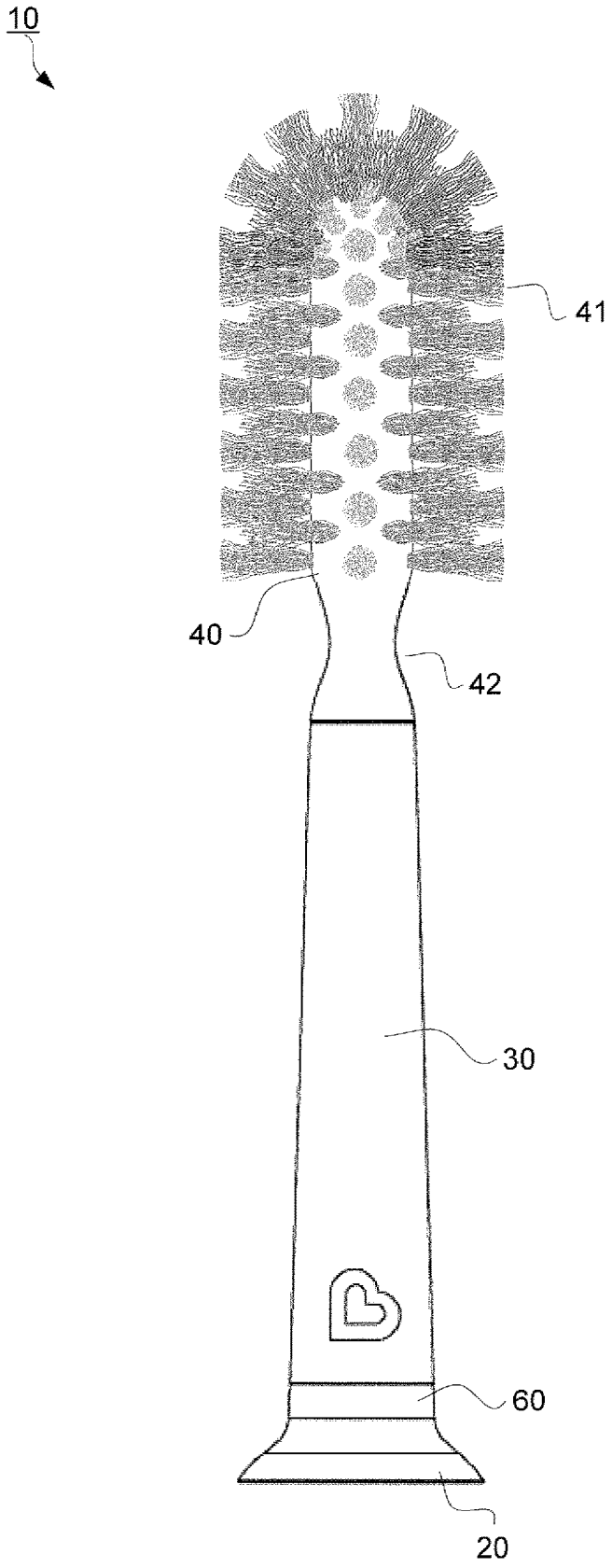
FIG. 1 is a modular brush system of the present subject matter.

Particular embodiments of the present invention will now be described in greater detail with reference to the figures.

The subject disclosure is described with reference to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

Figure 2:
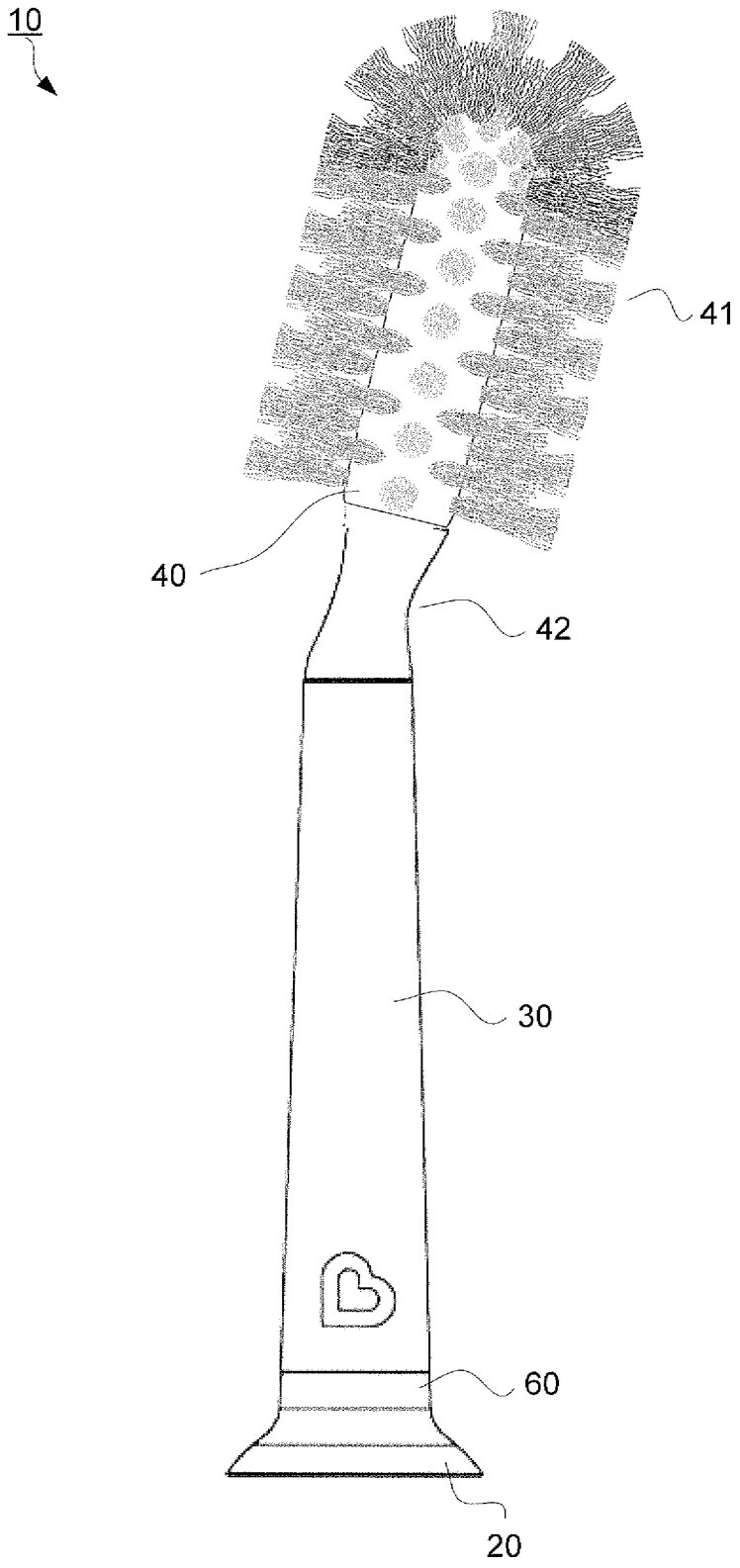
FIG. 2 is the modular brush system having a flexible neck.

FIGS. 1-2 illustrate an exemplary embodiment of the present subject matter presented as a modular brush system 10 that is both modular and flexible. The modular brush system 10 has a base portion 20, a handle 30 and a flexible top portion or stem 40 having bristles 41 and a flexible neck 42. All of the embodiments shown in the present application contain these components so they will ail be similarly labeled.

FIG. 1 shows the flexible neck 42 in a straightened position, and FIG. 2 shows the flexible neck 42 in a bent position. The neck 42 may alternatively be constructed to have a natural bend in its rest position. As shown in FIG. 1, the neck 42 is naturally straight and allowed to bend with force. This ability for the neck 42 to flex with moderate force allows for the bristles 41 to move around within the interior more difficult corners of a bottle from various positions of the handle 30.

Figure 3:
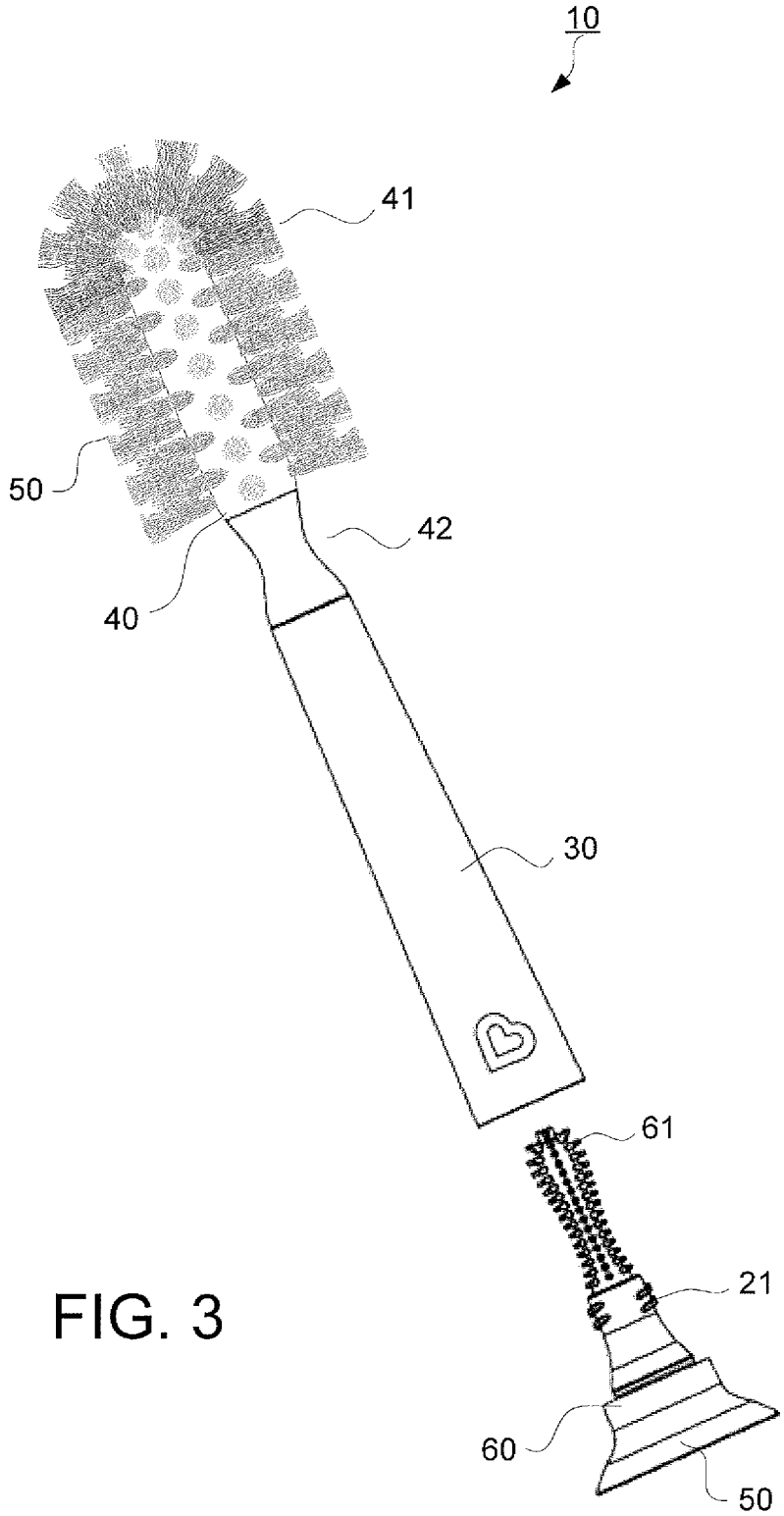
FIG. 3 shows an embedded smaller nipple brush within the handle of a larger bottle brush.

FIG. 3 shows a combined top bottle brush 50 and a nipple brush 60. The nipple bush 60 is adapted to fit within the handle 30 of the bottle brush 50. The bristles 61 of the nipple brush 60 extend from a top portion or stem 62 connected to a threaded portion 21 on the base 20. With this configuration, the modular brush system 10 is configured to conveniently scrub baby bottles using the bristles 41 on the bottle brush 50 and to conveniently scrub nipples with the smaller bristles 61 disposed on the top portion 62 of the nipple brush 60.

Figure 4:
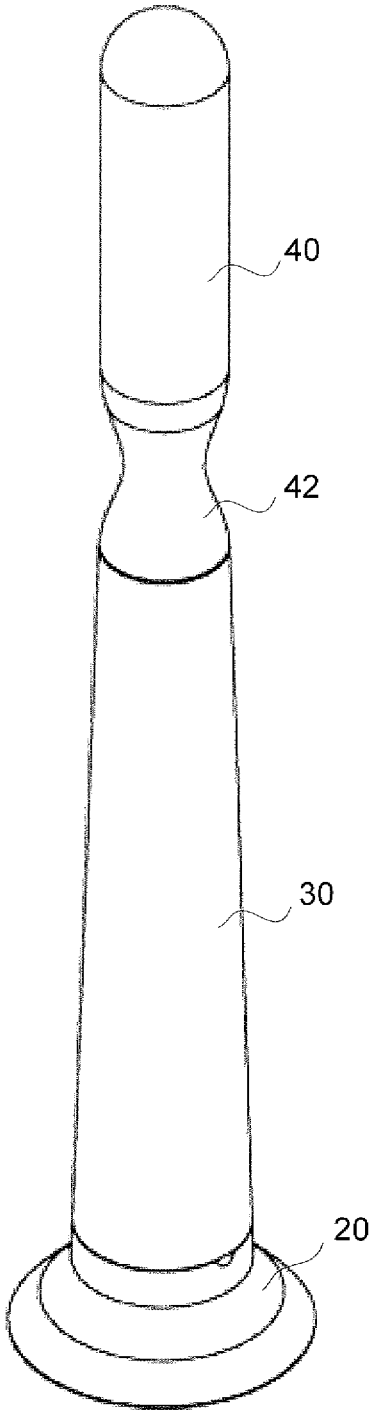
FIG. 4 illustrates the modular brush system without the bristles for simplicity.
Figure 5:
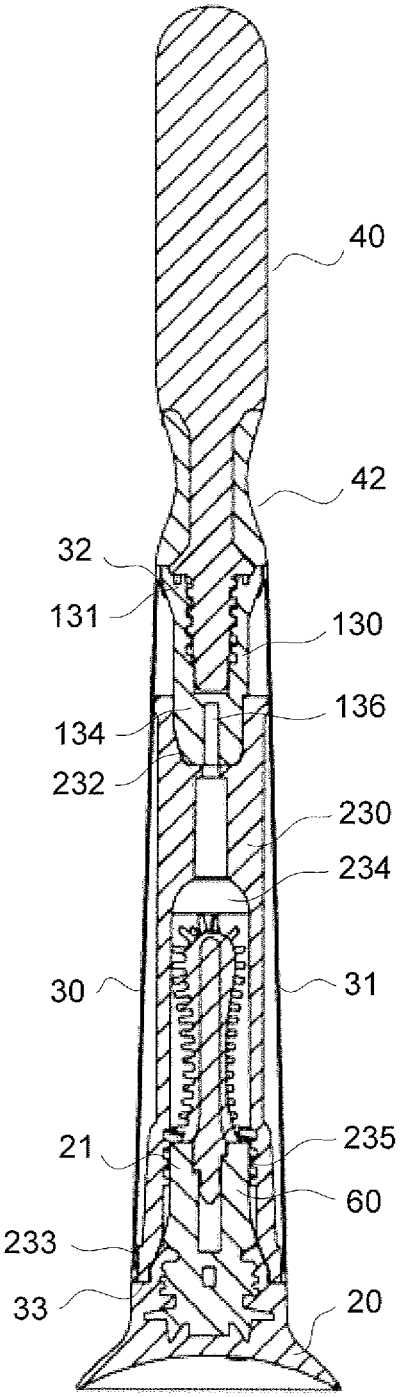
FIG. 5 is a cross section view of the modular brush system.

FIG. 4 illustrates the modular brush system 10 without the bristles for ease of illustration. FIG. 5 shows a cross section of the modular brush system 10 shown in FIG. 4. The brush system 10 is designed to be modular with interchangeable and replaceable parts. As shown, the handle 30 encloses a first core 130 and a second core 140 assembly. The first core 130 includes a first end 131 attached to a first end 32 of the housing 31, and the second core 230 includes a second end 233 attached to a second end 33 of the housing 31.

Figure 6:
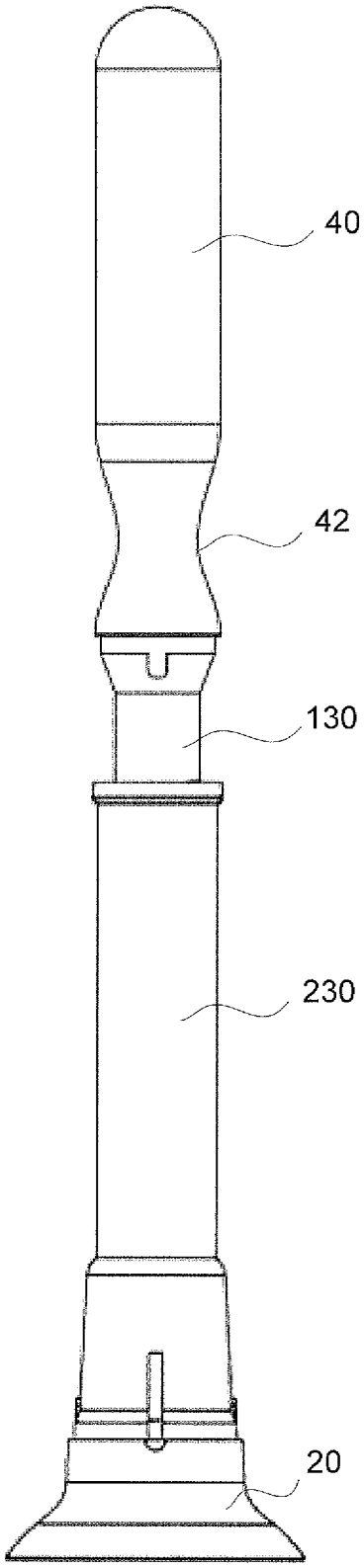
FIG. 6 depicts the modular brush system without the bristles and handle housing for simplicity.
Figure 7:
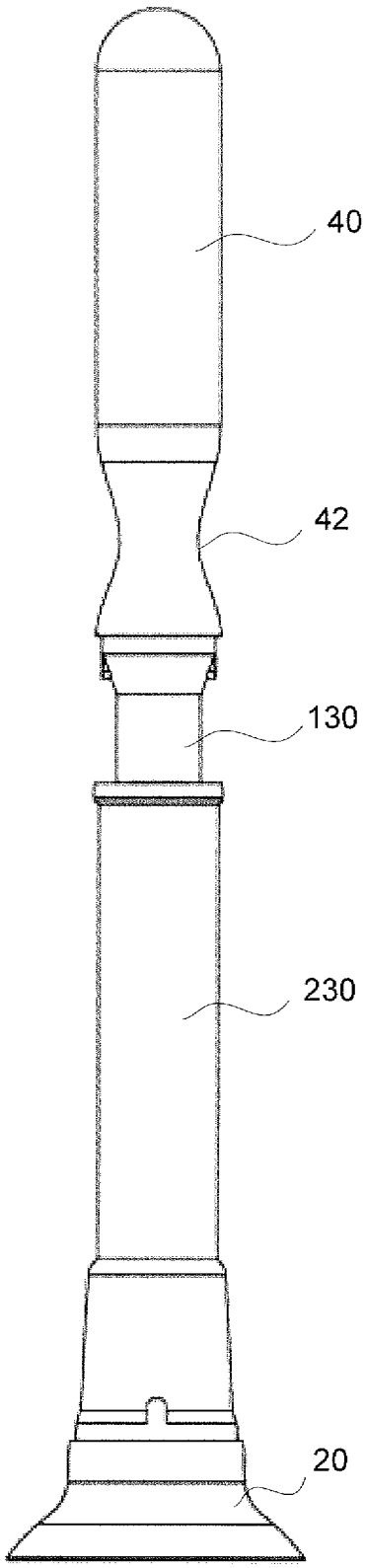
FIG. 7 is a side view of the modular brush system without the bristles and handle housing.
Figure 8:
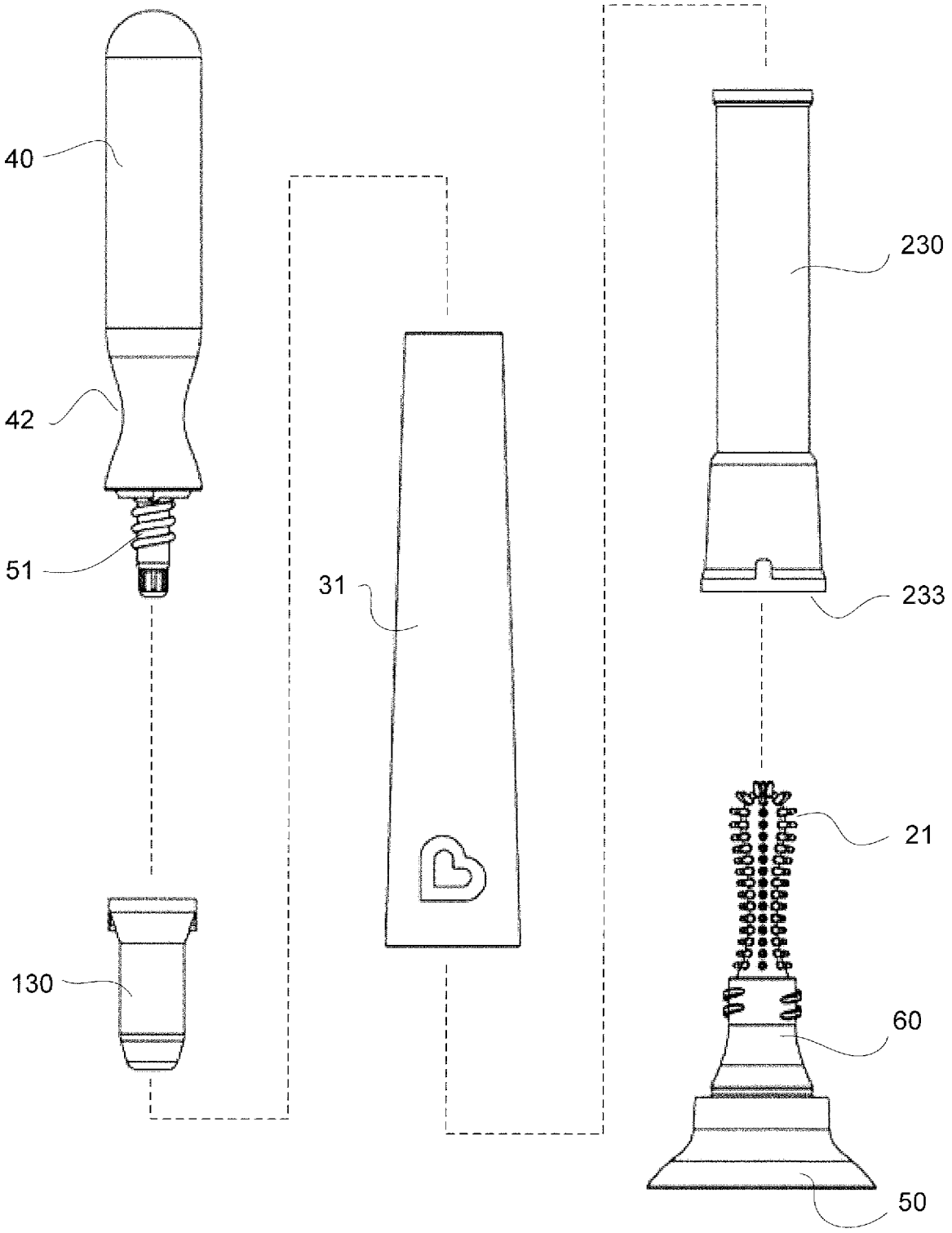
FIG. 8 is an exploded view of the modular brush system.

For simplicity, FIGS. 6-7 depict the front and side views of the modular brush system 10 without the bristles 41 or the handle housing 31. FIG. 8 illustrates an exploded view of the modular brush system 10. In construction, a stem 40 having a flexible neck 42 is connected to the first core 130. Through the handle housing 31, the first core 130 is connected to the second core 230. The second core 230 receives the nipple brush 60 within a recess 235 disposed in the second end of the second core 230.

Figure 9:
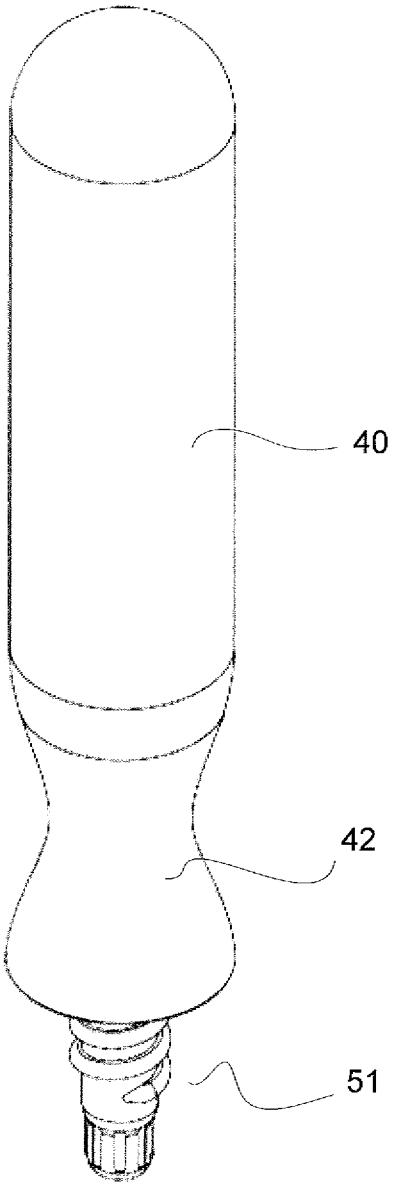
FIGS. 9-10 is an upper and lower perspective view of the flexible stem.
Figure 10:
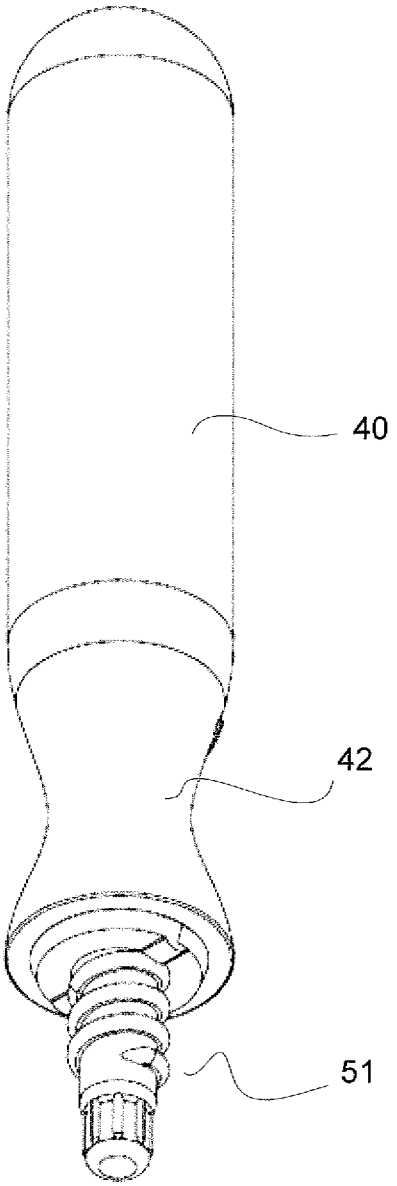

FIGS. 9-10 show an upper and a lower perspective view of the stem 40. The stem 40 includes a flexible neck 42 and a threaded end 51 for attachment to the first core 130. The flexible neck 42 is narrowed in diameter to allow the stem 40 to flex under a predetermined force exerted by a user during scrubbing as shown in FIG. 2. The advantage of constructing the stem 40 to have a threaded end 51 is the ability to interchangeably replace a worn out brush 41 after repeated use as opposed to replacing the entire modular brush system 10 including nipple brush 60. Oftentimes, the handle 30 and the remainder of the brush system 10 is fully functional but the stem 40 and brush 41 have been worn and require replacement after repeated use. As such, the modular stem 40 and brush 41 may be replaced by removing the stem 40 at the threaded end 51 from the first core 130 and replacing the stem 40 with a new stem 40 having a new brush 41.

Figure 11:
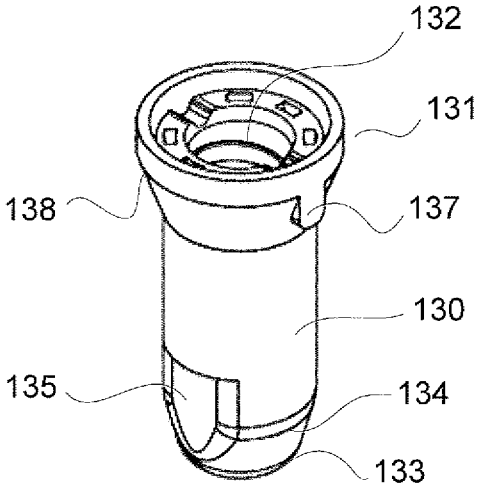
FIGS. 11-12 are upper and lower perspective views of the first core.
Figure 12:
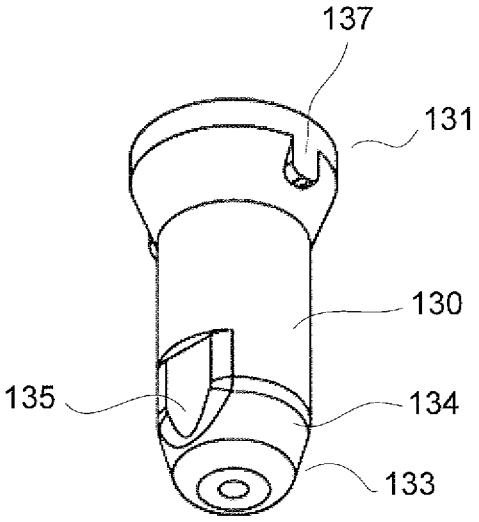
Figure 13:
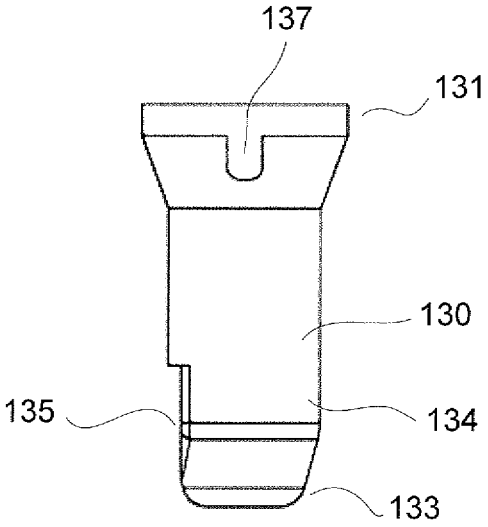
FIG. 13 is a side view of the first core.

FIGS. 11-13 depict the first core 130. As also shown in FIG. 5, the first core 130 includes a first end 131 attached to a first end 32 of the housing 31 shown in FIGS. 14-16. The second core 230 includes a second end 233 attached to a second end 33 of the housing 31.

The first core 130 has a first end 131 with a first socket 132 adapted to receive the threaded end 51 of the lower end portion of the stem 40. The first core 130 has a second end 133 constructed as a plug 134 adapted to be attached to the second core 230.

Figure 17:
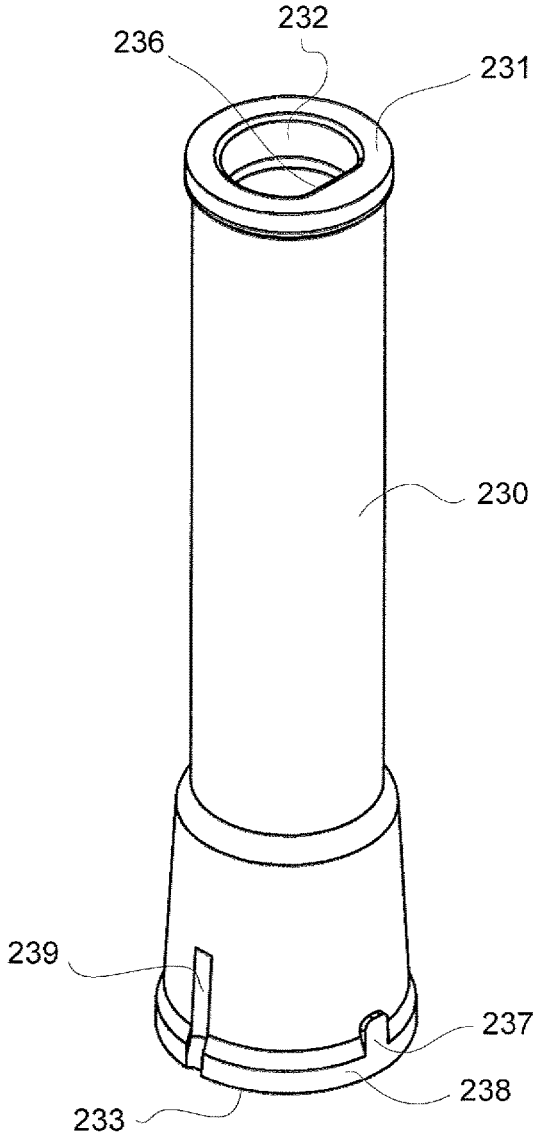
FIGS. 17-18 are upper and lower perspective views of the second core.
Figure 18:
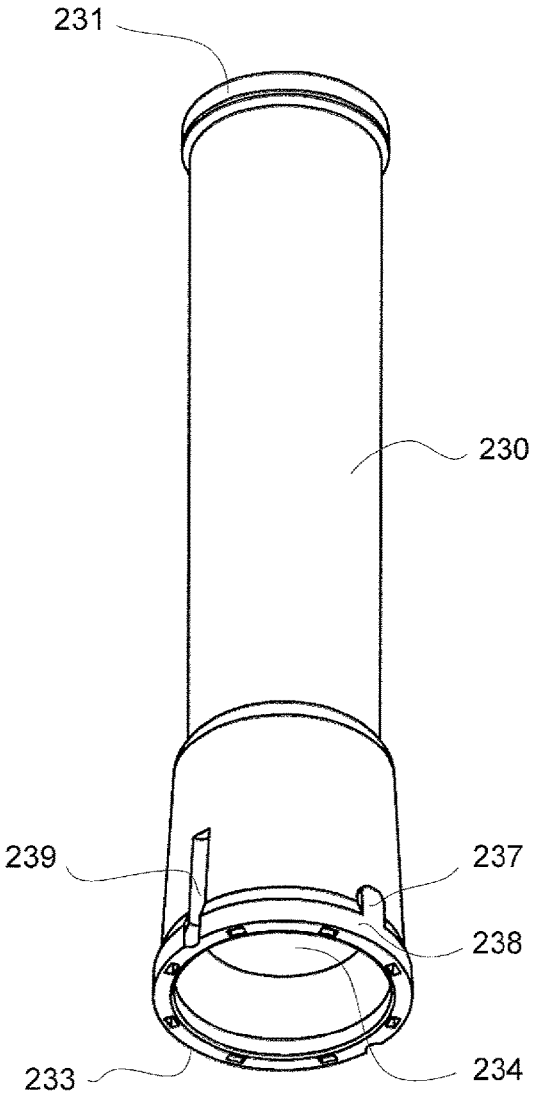

FIGS. 17-18 depict the second core 230 having a first end 231 having a socket 232 adapted to receive the plug 134 of the first core 130. The plug 134 disposed at the second end 133 of the first core 130 may be constructed to be connected via a key connection as shown in FIGS. 11-13 and 17. That is, the end of the plug 134 may have a first notch shape 135 that fits into a mating second notch shaped recess 236 provided in the first end 231 of the second core 230. When the first notch shape 135 is plugged into the mating second notch shaped recess 236, the first core 130 will not rotate relative to the second core 230. In FIG. 5, a threaded element 136 is shown fastening the plug 134 of the first core 130 to the socket 232 of the second core 230. It is to be understood that the plug 134 may be attached within the socket 232 in a variety of different ways, such as by sonically welding, an adhesive, a mechanical fastener and/or any other suitable attachment according to this subject disclosure.

Figure 19:
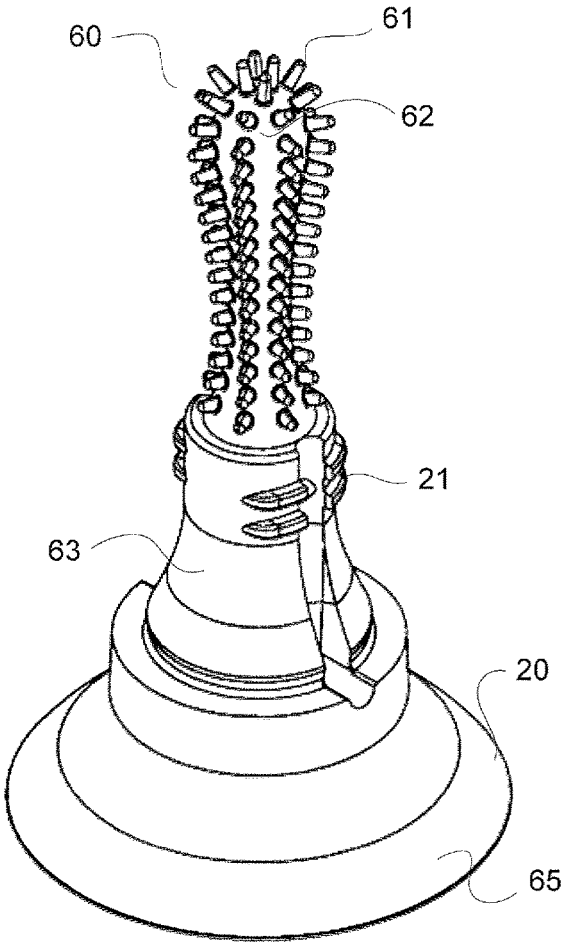
FIGS. 19-20 are upper and lower perspective views of the nipple brush.
Figure 20:
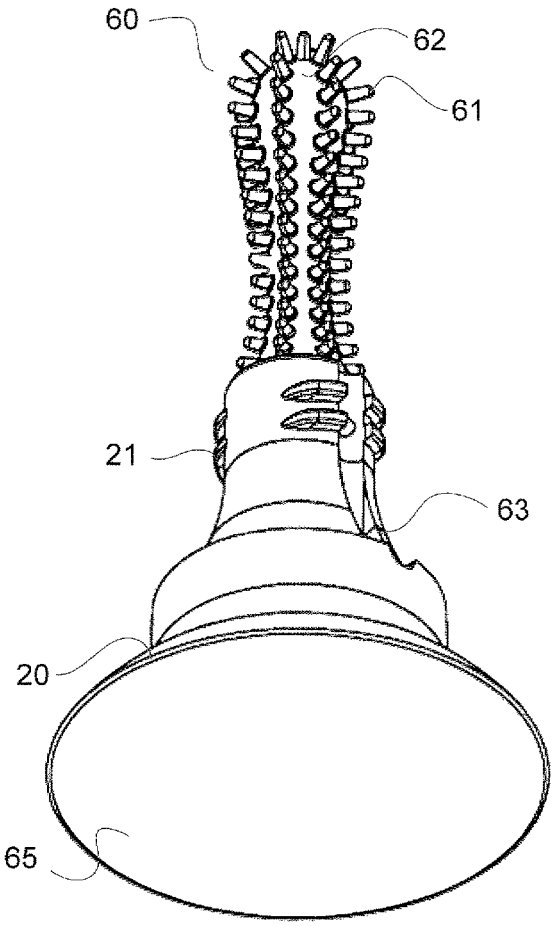

The second end 233 of the second core 230 has a recess 234 adapted to receive the top portion 62 of the nipple brush 60 shown in FIGS. 19-20. The recess 234 has a female threaded portion 235 (as shown in FIG. 5) adjacent to the peripheral second end 233. The female threaded portion 235 is adapted to receive and attach to the male threaded portion 21 of the base 20 so that the nipple brush 60 may be removably secured to the handle 30 of the bottle brush 50 as shown in FIGS. 3 and 19-20.

Referring back to FIG. 5 and FIGS. 11-16, the first core 130 includes a first end 131 attached to a first end 32 of the housing 31, and the second core 230 includes a second end 233 attached to the second end 33 of the housing 31.

The housing 31 may be attached to the first core 130 and the second core 230 by an alignment assembly. The alignment assembly may be constructed of various alignment notches 137 (shown in FIGS. 11-13), 237 (shown in FIGS. 17-18) and mating alignment recesses 36, 37 (shown in FIGS. 14-15).

Figure 14:
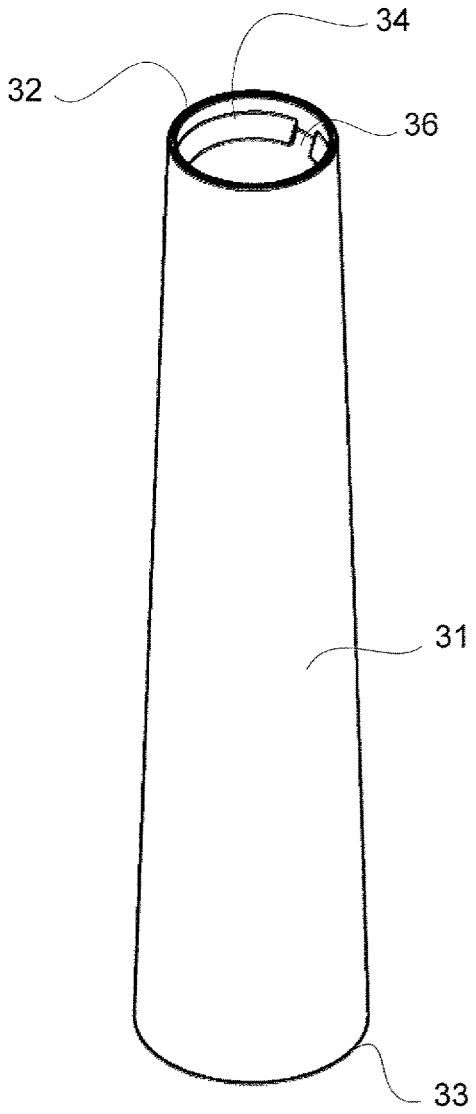
FIGS. 14-15 are upper and lower perspective views of the handle housing.
Figure 15:
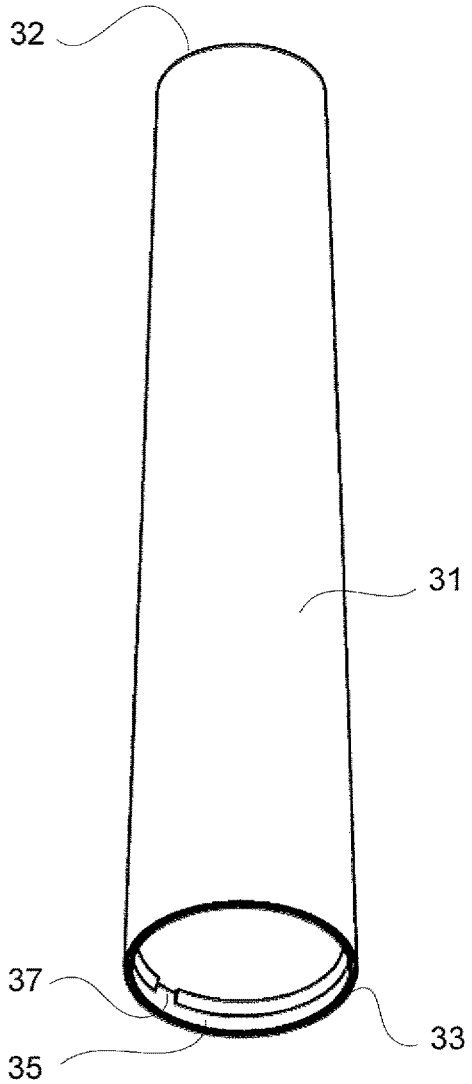
Figure 16:
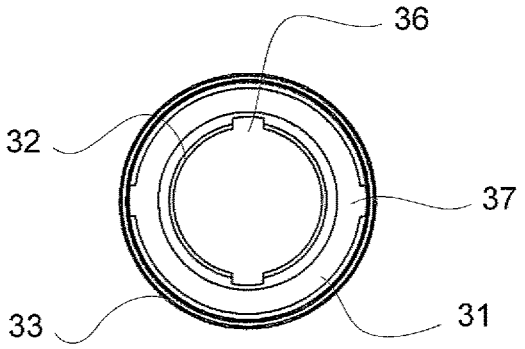
FIG. 16 is a bottom view of the handle housing.

That is, as shown in FIGS. 11-13, an outer surface 138 adjacent to the first end 131 of the first core 130 has an alignment notch 137 that can be aligned with an alignment recess 36 on a first inner surface 34 of the housing 31 as shown in FIGS. 14-15. Likewise, on an outer surface 238 adjacent to the second end 233 of the second core 230, an alignment notch 237 may be provided that can be aligned with an alignment recess 33 on a second inner surface 35 of the housing 31 as shown in FIGS. 15-18. The combination of the complementing alignment notches 137 on the first core 130, 237 on the second core 230 and alignment recesses 32 and 33 on the handle housing 31 ensures a pre-determined and snug fit between the first core 130 and the second core 230 within the housing 31, respectively.

FIGS. 17-18 depict a drain 239 may be provided in the handle 30 to remove any fluid that happens to seep under the handle housing 31. The drain 239 may be embodied as a slot recessed in the second core 230 that leads any fluid outside of the housing 31.

The handle 30 may include a resilient outer grip surface and/or may be made of a stiff material, such as a metallic material. The outer grip may be fabricated from a resilient polymeric material that is dishwasher-proof, such as polycarbonate, an ABS plastics or other suitable material.

The bottle brush 50 is sized and configured to efficiently scrub an inside of a baby bottle. The bristles 41 of the brush 50 are connected to the flexible top portion or stem 40. The flexible stem 40 may include a bristle end or a sponge-like end for scrubbing. The bristles 41 on the stem 40 of the brush 50 may be cylindrical in shape and/or any other suitable shape adapted for scrubbing purposes.

FIGS. 19-20 illustrate the nipple brush 60. The nipple brush 60 includes a grip portion 63 and a top portion or stem 62. The stem 62 may include bristles 61. The bristles 61 may take a variety of different sizes and/or shapes. The grip portion 63 is disposed below the bristles 61 at the lower end of the nipple brush 60. Various threads 21 may be disposed on the base 20 of the nipple brush 60 below the grip portion 63 may be constructed in a variety of different ways, such as a suction cup 65 adapted to be attached to a surface while in use or as a flat base to stand upright while in use. The grip portion 63 may have a hole (not shown) defined therein for hanging the modular brush system 10 on a peg or other projection.

In the assembled orientation depicted in FIGS. 1-2, the nipple brush 60 may be releasably attached (as shown in FIG. 3) within the handle 30 in a variety of different ways as show, such as by an interference fit, a threaded attachment or any other suitable releasable attachment mechanism. An interference fit would be constructed to withstand a withdrawal force when locked that would at least exceed the entire weight of modular brush system 10, so that the entire brush system 10 may be hung from grip portion of nipple brush assembly. Alternatively, a twist fit (such as shown by male 21 and female 235 threaded attachment) or snap-in fit connection could be provided in the base of the nipple brush.

When the nipple brush 60 is stored within the recess 234 of the brush handle 30, the nipple brush 60 is insulated against contact with germ-laden surfaces such as countertops, sinks, or other utensils. Likewise, use of a hole in the grip portion 63 of the handle 64 enables the entire brush to be hung in a location where contact with other utensils or surface is unlikely.

The handle grip portion or any other portion of the modular brush system 10 may include an ornamental design, such as a heart-shaped design and/or any other suitable shape.

Figure 21:
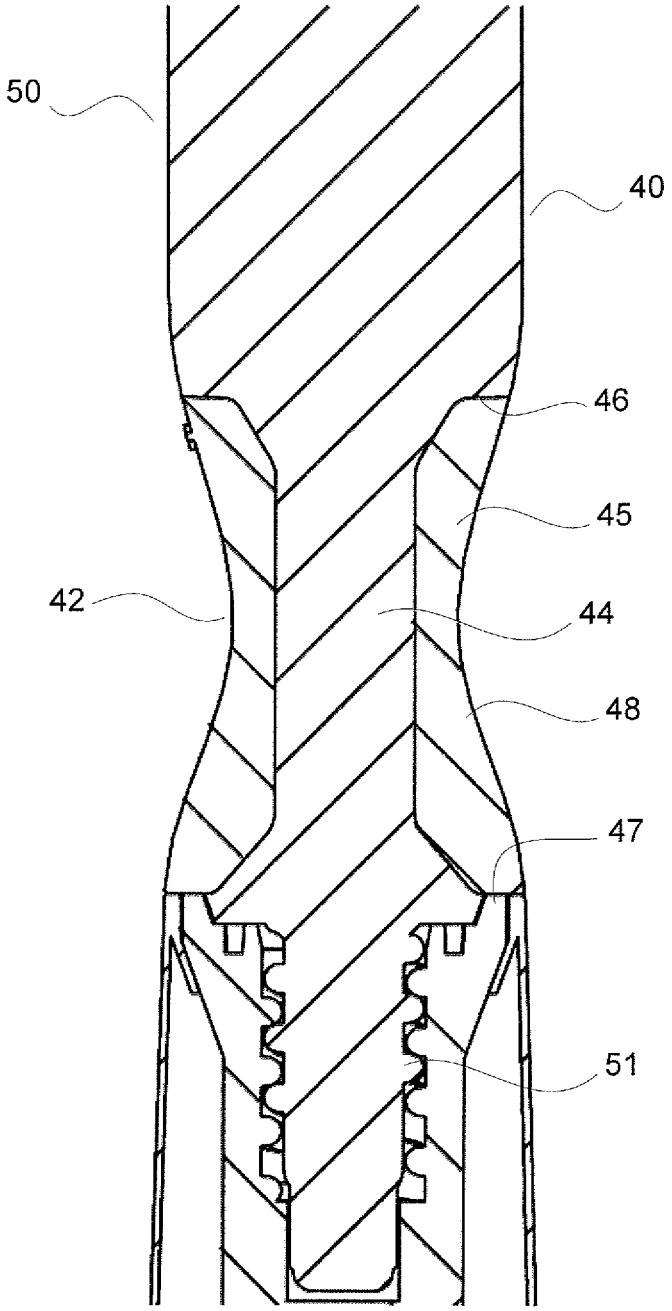
FIG. 21 is an enlarged view of the flexible neck of the brush.
Figure 22:
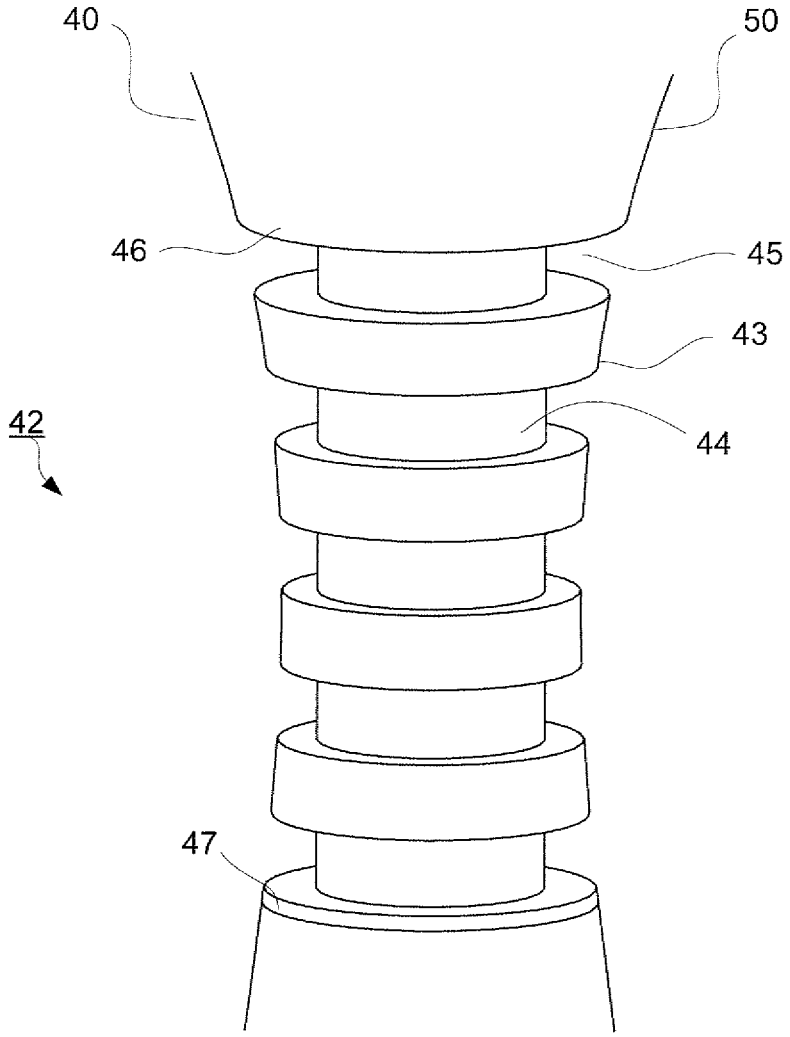
FIG. 22 is another enlarged view of the flexible neck of the brush.
Figure 23:
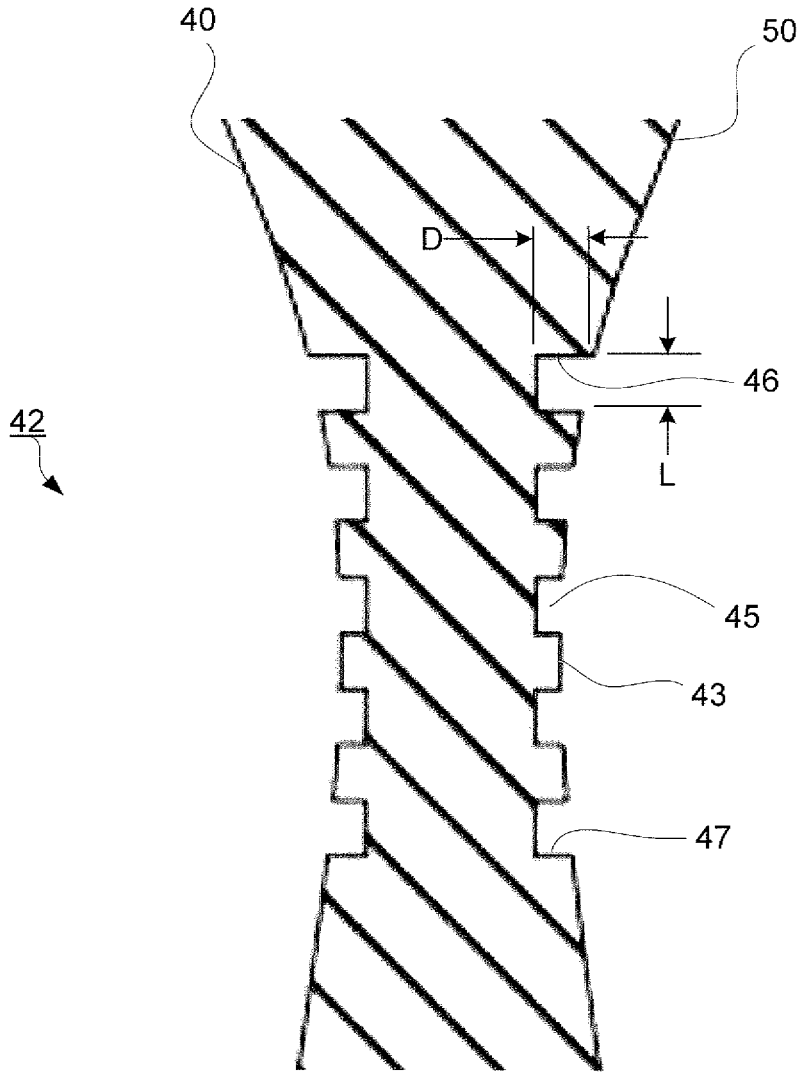
FIG. 23 depicts an enlarged cross section view of the flexible neck of the brush.

The modular brush system 10 includes a flexible neck 42 that may take a variety of different configurations, such as a spine-like configuration and/or other suitable flexible configuration according to this subject disclosure. As shown in FIGS. 21-23, the flexible neck portion 42 may be configured to include one or more central post portions 44 having one or more gaps 45 disposed along the length of each post 44.

FIG. 21 shows an embodiment where a single post 44 defines a gap 45 between the stem 40 and the threaded end 51 of the upper end of the bottle brush 50. In particular, the gap 45 is defined such that an upper and a lower end of the post 44 are concentrically reduced in diameter inward from an upper concentric wall 46 and a lower concentric wall 47 to the surface of the stem 40 to a predetermined diameter defining the outer surface of the post 44. A material 48 is disposed within the gap 45. The material 48 is a resilient material provided between the gaps 45 to define the amount of bend that the neck 42 of the handle 30 is capable of enduring.

FIG. 22 shows that various discs 43 can be constructed along the central post 44 to define various gaps 45 bordering each of the discs 43. The modular brush system 10 may be constructed to have an outer profile nearly contiguous with an outer surface of the handle 30 when the resilient material 48 is provided within the gaps 45. The gaps 45 are recessed into the outer surface of the stem 40 at a neck 42 region creating a spine-like configuration.

The spine-like structure is bounded by two walls, the upper concentric wall 46 and the lower concentric wall 47. Various discs 43 are provided between the two walls 46, 47. The various discs 43 are separated by a gap 45 having a predetermined space length L as shown in FIG. 21. For example, the top disc 43 is separated from the upper concentric wall 46 by a gap space 45 having a distance of L. The depth of the gap 45 is at a predetermined distance D inward of the outer surface of the stem 40 the brush 50.

Figure 24:
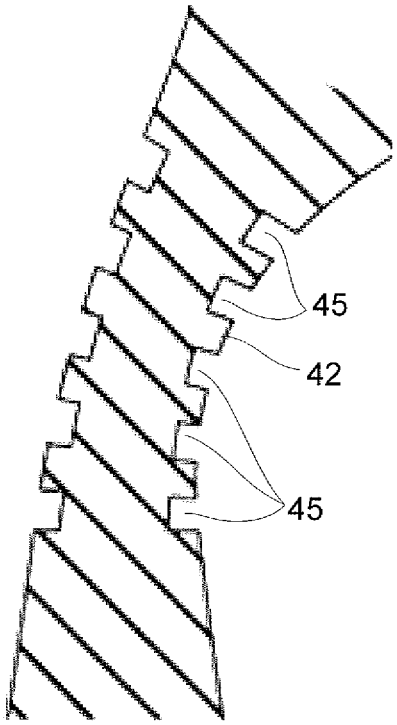
FIG. 24 shows the enlarged cross section view of the flexible neck slightly bent.
Figure 25:
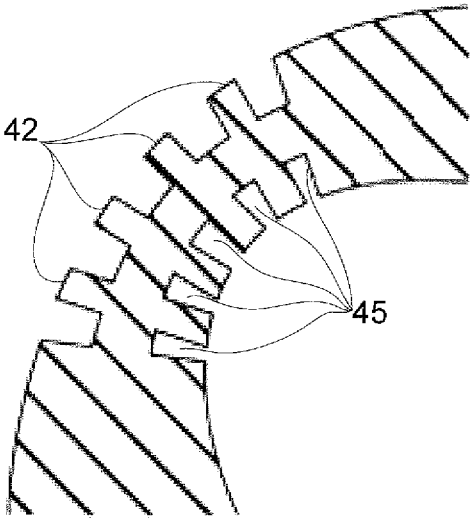
FIG. 25 illustrates the enlarged cross section view of the flexible neck sufficiently bent.

As shown in FIGS. 24-25, as the neck 42 of the brush 10 is bent over to one side, the gaps 45 close up in the direction of the bend, and the gaps 45 on the outside of the neck 42 of the brush 10 open up or spread apart. The combination of the dimension of the gaps, the space length L, the depth D, the material used for the substrate and the resilient material disposed between the gaps, all define the amount of bend that the neck 42 of the handle 30 is capable of enduring.

Figure 26:
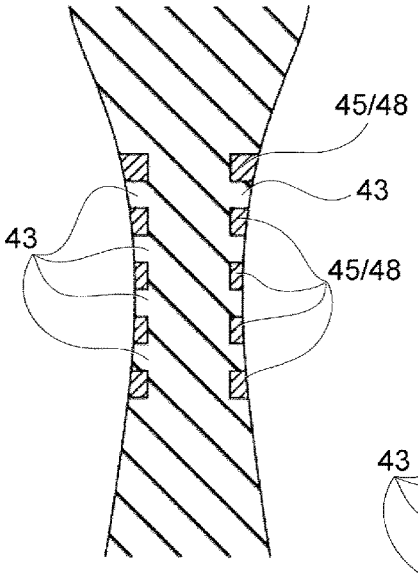
FIG. 26 depicts an enlarged cross section view of the neck of the flexible neck with the resilient material.
Figure 27:
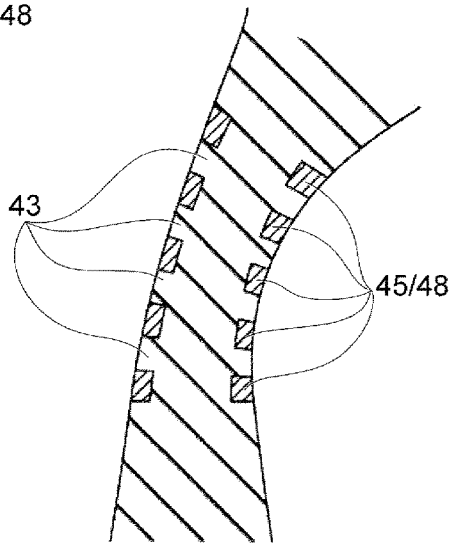
FIG. 27 shows the enlarged cross section view of the flexible neck with the resilient material slightly bent.
Figure 28:
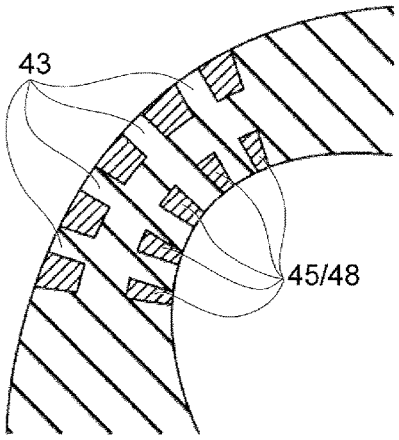
FIG. 28 illustrates the enlarged cross section view of the flexible neck with the resilient material sufficiently bent.

As shown in FIGS. 26-28, the gaps 45 between discs 43 may be filled with a material 48 having desired properties. If the material substrate 48 used is a material having higher flexibility properties, then the substrate will have the propensity to bend more. Likewise, if the resilient material 48 disposed in the gaps 45 between the discs 43 is soft, the neck 42 will have a higher propensity to bend. However, if the resilient material 48 disposed in the gaps between the discs is of a harder, less flexible material, the neck 42 will have a lower propensity to bend. In this manner, the flexibility of the modular brush system 10 can be tailored to bend at a desired angle and with sufficient resiliency to rebound during use.

Figure 29:
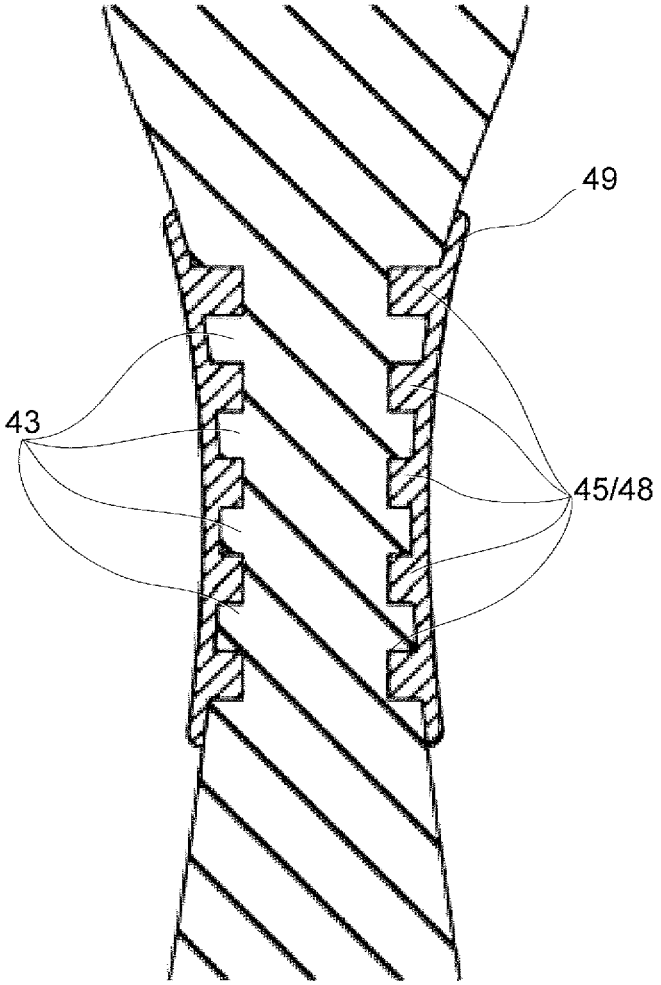
FIG. 29 depicts an enlarged cross section view of the flexible neck including another configuration for the resilient material.

FIG. 29 illustrates another exemplary embodiment in which the resilient material 48 disposed in the gaps 45 between the discs 43 is connected by an outer sleeve portion 49 that interconnects each of the concentric plugs provided within the gaps 45. The outer sleeve portion 49 may be of the same or different material than the resilient material 48 within the gaps 45. Further, the discs 43 may, or may not be visible from underneath the sleeve portion 49 thereby allowing for a more uniform external appearance along the sleeve portion 49.

As shown in FIGS. 21 and 30-35, various geometries are possible for the spine-like configuration to vary the amount of bend in the neck 42 of the brush system 10. As shown, the distance between the upper concentric wall 46 and the lower concentric wall 47 can be varied. The number of discs 43 can be modified between the two walls 46, 47 to vary the flexibility of the neck 42. The gap 45 and space length L between each of the discs 43 and/or the walls 46, 47 can be modified to vary the flexibility of the neck 42. The depth (D) of the gap 45 can also be changed to vary the flexibility of the neck. Likewise, the predetermined depth distance D inward from the outer wall of the stem 40 inward can be modified to vary the flexibility of the neck 42.

Figure 30:
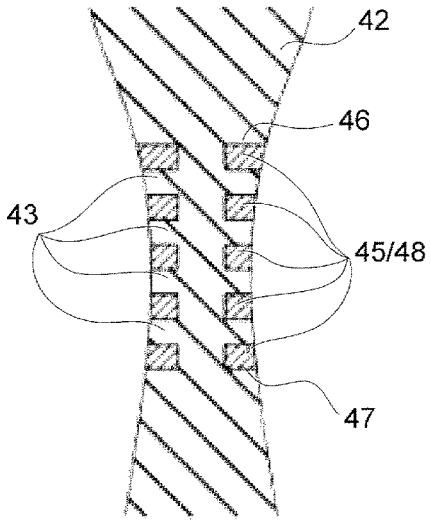
FIGS. 30-35 are various enlarged cross section views of the spine-like configuration of the flexible neck.
Figure 31:
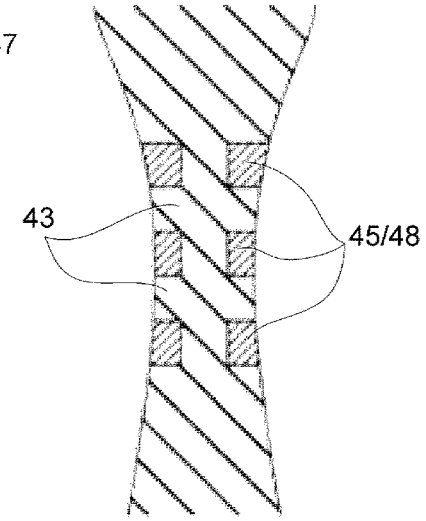
Figure 32:
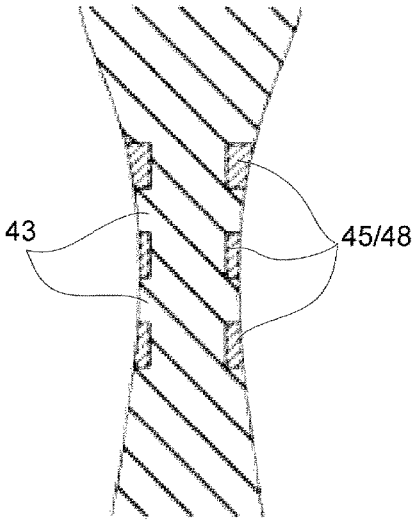
Figure 33:
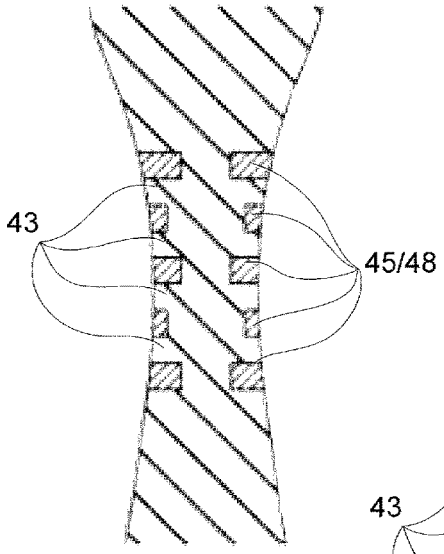
Figure 34:
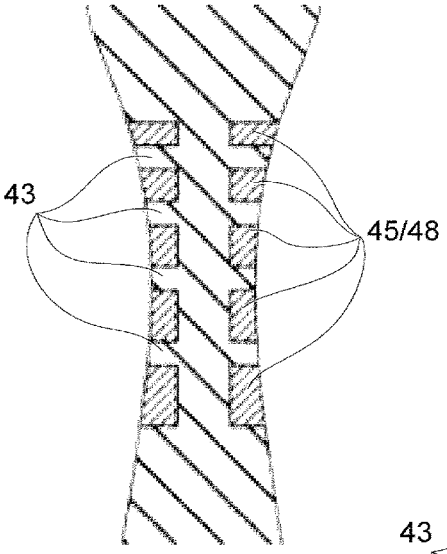
Figure 35:
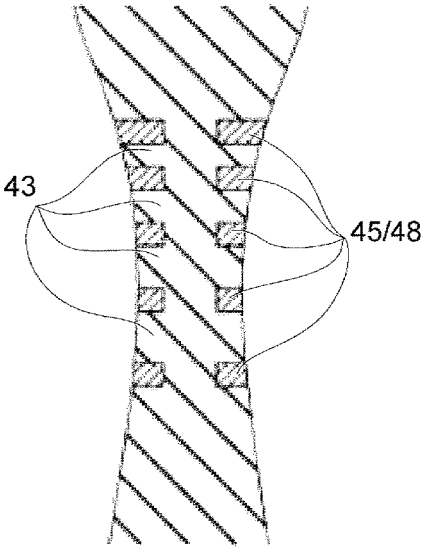

In the exemplary embodiment of FIG. 30, each of the gap portions 45 contains a relatively equal amount of resilient material 48 and all discs 43 are similarly sized and equidistant from each other. In the exemplary embodiment of FIG. 31, each of the gap portions 45 contains a relatively equal amount of resilient material 48 but the gap portions are relatively large and the space between each gap portion 45 is large as well with only a few discs 43 being present. In the exemplary embodiment of FIG. 32, each of the gap portions 45 contains a relatively small depth of resilient material 48 and the discs 43 are relatively large and flat. In the exemplary embodiment of FIG. 33, the gap portions 45 alternate between large and small volumes of resilient material 48, and the discs 43 alternate in size correspondingly. In the exemplary embodiment of FIG. 34, the gap portions 45 steadily change from a long and narrow resilient material 48 to a relatively flat and large. In the exemplary embodiment of FIG. 35, each of the gap portions 45 contains an increasingly larger distance between the resilient material 48 with the depth of the resilient material 48 changing along the length of the flexible neck 42. One of ordinary skill in the art would appreciate these various parameters may be varied for particular flexibility characteristics, according to the present subject disclosure.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples of a modular and interchangeable brush system that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed is:

1. A device to scrub a container, comprising:

a handle having a first core and a second core;

a flexible stem removably connected to the first core of the handle, the flexible stem having at least one gap being a reduced area around the stem having a reduced diameter less than a diameter of the flexible stem, into which a resilient material is disposed providing a bend location relative to a longitudinal axis of the handle;

a first brush operatively connected to the flexible stem; and a second brush operatively connected to, and received within, the second core of the handle;

wherein the first brush, the handle, and the second brush share the same extended central axis.

2. The device of claim 1, wherein the second brush is smaller than the brush and is sized and configured to efficiently scrub an inside of a smaller container.

3. The device of claim 2, wherein the second brush attaches to the second core through a threaded connection that mates with internal threads disposed within the second core.

4. The device of claim 1, wherein the first core and the second core are fixedly attached.

5. The device of claim 1, wherein the flexible stem having a spine-like configuration.

6. The device of claim 5, wherein the spine-like configuration comprises at least two discs having similar diameter and depth.

7. The device of claim 5, wherein the spine-like configuration comprises at least two discs having varying diameters and depths.

8. A device to scrub a container, comprising:

a handle;

a flexible stem removably connected to the handle, the flexible stem having a neck portion with a gap of a reduced area in the flexible stem;

a resilient material of a predetermined hardness disposed in the gap in the neck, the flexible stem adapted to bend at a predetermined angle relative to a longitudinal axis of the handle; and a brush operatively connected to the flexible stem and sized to efficiently scrub an inside of the container;

wherein the brush, the flexible stem, and the handle share the same extended central axis.

9. The device of claim 8, further comprising a second brush that is removably connected to, and received within, the handle.

10. The device of claim 8, wherein the gap has a spine-like configuration comprises at least two discs having similar diameter and depth.

11. The device of claim 8, wherein the gap has a spine-like configuration comprises at least two discs having varying diameters and depths.

12. The device of claim 8, wherein the handle further comprises a first core attached to a second core, wherein the flexible stem is removably attached to the first core and the second brush is removably connected to the second core of the handle.

13. The device of claim 12, further comprising a sleeve into which the first core and the second core are disposed.

14. A device to scrub a container, comprising:

a handle having a first core and a second core;

a stem removably connected to the first core of the handle, the stem having a flexible neck of a reduced thickness disposed at a bend location;

a resilient material of a predetermined hardness disposed around the flexible neck, the stem adapted to flex at the bend location a predetermined angle relative to a longitudinal axis of the handle; and a brush operatively connected to the stem and sized to efficiently scrub an inside of the container;

wherein the brush, the stem, and the handle share the same extended central axis.

15. The device of claim 14, further comprising a second brush operatively connected to, and received within the second core of the handle, the second brush being smaller than the brush and sized to efficiently scrub an inside of a smaller container.

16. The device of claim 15, wherein the second brush attaches to the second core by at least one of a friction fit or a threaded connection.

17. The device of claim 14, wherein the flexible neck of the reduced thickness is configured as discs have the same diameter and depth.

18. The device of claim 14, wherein the flexible neck of the reduced thickness is configured as discs have varying diameters and depths.

19. The device of claim 14, wherein the handle further comprises a sleeve into which the first core and the second core are disposed.

* * * * *